US007032281B1

(12) United States Patent
Lin

(10) Patent No.: US 7,032,281 B1
(45) Date of Patent: Apr. 25, 2006

(54) RIVET-STROKE ADJUSTING DEVICE FOR A RIVET-NUT GUN

(76) Inventor: Yu-Ching Lin, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 11/059,402

(22) Filed: Feb. 17, 2005

(51) Int. Cl.
*B21J 15/00* (2006.01)
*B21J 15/30* (2006.01)

(52) U.S. Cl. ..... 29/243.525; 29/243.523

(58) Field of Classification Search ..... 72/391.4; 29/243.521, 243.522, 243.523, 243.524, 29/243.525
See application file for complete search history.

(56) References Cited

U.S. PATENT DOCUMENTS 5,357,666 A * 10/1994 El Dessouky et al. .. 29/243.521
6,425,170 B1 * 7/2002 Zirps et al. ..... 29/243.525
6,449,822 B1 * 9/2002 Gilbert et al. ..... 29/243.521
6,622,363 B1 * 9/2003 Komsta ..... 29/243.525
6,907,648 B1 * 6/2005 El Dessouky ..... 29/243.525

* cited by examiner

*Primary Examiner*—David B. Jones
(74) *Attorney, Agent, or Firm*—Troxell Law Office, PLLC

(57) ABSTRACT

A rivet-stroke adjusting device for a rivet-nut gun, in which the parts mounted between the cylindrical hole of the mounting base on front end of the body portion and the outer sleeve of the rivet-pulling assembly include an outer sleeve with a cylindrical hole and a threaded hole, a thread sleeve, a spring, an adjustment ring, a steel pin and a screw; the center cylindrical hole of the adjustment ring is mounted to a pull shaft of the hydraulic piston of the mounting base by means of pin hole; the outer threads of the adjustment ring are screwed together with threads on one end of the outer sleeve, being pushed and limited with a spring; when the outer sleeve is turned, the adjustment ring will be pushed to move so as to have the pull shaft of the hydraulic piston moved a stroke.

7 Claims, 10 Drawing Sheets

RIVET-STROKE ADJUSTING DEVICE FOR A RIVET-NUT GUN

BACKGROUND OF THE INVENTION

1. Field of the Invention

This invention relates to a rivet-nut gun, and particularly to a rivet-stroke adjusting device for rivet-nut gun.

2. Description of the Prior Art

In the conventional rivet-nut gun, the rivet-pulling assembly must be adjusted and changed upon mounting a rivet nut, using hydraulic riveting, and the pull rod returning so as to facilitate different rivet nut in riveting work; when the length of the rivet nuts is different, adjustment must be done by removing the outer sleeve first, and then adjusting a thread ring with a pin.

SUMMARY OF THE INVENTION

The prime object of the present invention is to provide a rivet-stroke adjusting device for rivet-nut gun, in which the mounting base of the body portion is furnished with a cylindrical hole to be mounted with an outer sleeve of a rivet-pulling assembly; an adjusting device is mounted between the inner space of the outer sleeve and the pull shaft of the hydraulic piston; then, the riveting stroke can be adjusted by turning the outer sleeve of the rivet-pulling assembly.

Another object of the present invention is to provide a rivet-stroke adjusting device for rivet-nut gun, in which the cylindrical hole of the mounting base of the body portion is mounted with an outer sleeve; the round surface of the outer sleeve is furnished with a ring groove; both sides of the mounting base is furnished with two screw holes respectively for receiving two screws; the ends of the screws are set in the ring groove so as to limit the outer sleeve to rotate at one point; when the outer sleeve is turned, it will drive an adjustment ring on a pull shaft of the hydraulic piston to move so as to have a riveting stroke adjusted quickly.

Still another object of the present invention is to provide a rivet-stroke adjusting device for rivet-nut gun, in which the cylindrical hole of the mounting base of the body portion is mounted with a pull shaft of a hydraulic piston and a torque rod; the pull shaft is mounted with an adjustment ring of adjusting assembly and a spring; the outer end of the pull shaft is furnished with threads to enable a thread sleeve to mount; the adjustment ring is furnished with a pin hole for receiving a pin so as to have the adjustment ring mounted on a bottom round surface of the cylindrical hole; the outer threads of the adjustment ring are screwed together with the threads on one end of the outer sleeve; when the outer sleeve is turned, the adjustment ring will move laterally along the steel pin without rotating synchronously with the outer sleeve.

A further object of the present invention is to provide a rivet-stroke adjusting device for rivet-nut gun, in which a hydraulic piston is to be pulled inwards to provide a riveting work; the end of the pull shaft of the hydraulic piston on the mounting base is mounted with a thread sleeve; the adjustment ring and the inner threads of the outer sleeve are screwed together, and the motion of the adjustment ring is controlled completely with the outer sleeve; in other words, the riveting stroke for the rivet nut can be adjusted simply by turning the outer sleeve.

Still a further object of the present invention is to provide a river-stroke adjusting device for rivet-nut gun, in which the mounting base of the body portion is furnished with a longitudinal groove; the adjustment ring of the rivet-stoke adjusting assembly is furnished with a pin hole for receiving a U-shaped indication pin; the other end of the indication pin is positioned in the longitudinal groove near the scale thereof; upon the riveting stroke being adjusted, the scale pointed with the indication pin will directly show the distance of a riveting stroke adjusted.

DETAILED DESCRIPTION OF THE PREFERRED EMBODIMENT

Figure 1:
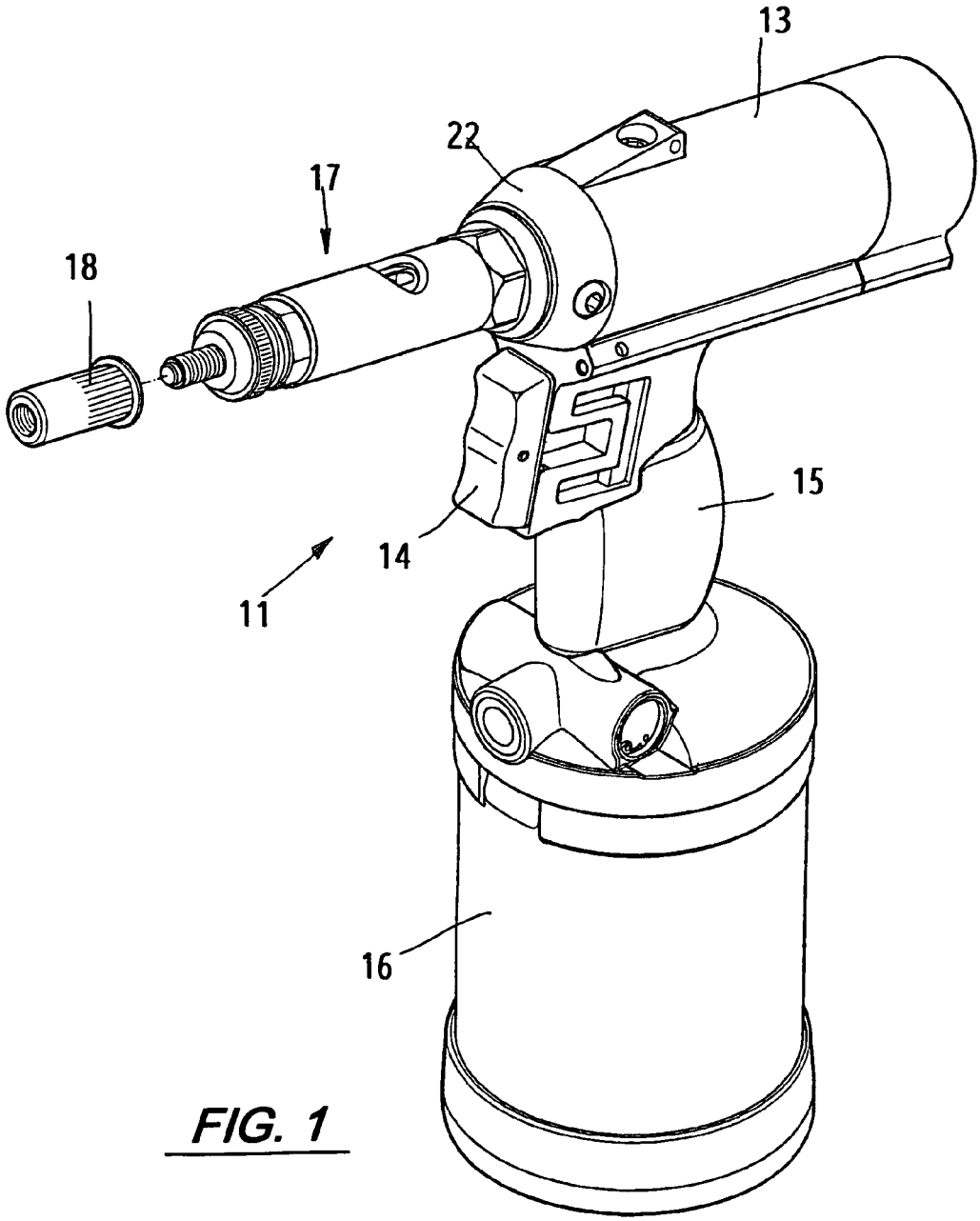
FIG. 1 is a perspective view of the present invention.

This invention relates to a rivet-stroke adjusting device for a rivet-nut gun; as shown in FIGS. 1 to 5, the inside of a mounting base 22 on the front end of the rivet-nut gun 11 is furnished with a cylindrical hole 23, of which the center is mounted with a pull shaft 24 and a torque rod 21 extended from a hydraulic piston 20. The pull shaft 24 is mounted with a rivet-stroke adjusting assembly 54, while the torque rod 21 is mounted with an inner sleeve 26 and a pull rod 12; the cylindrical hole 23 of the mounting base 22 is mounted with an outer sleeve 25 to be fastened in place with a screw 30; the outer end of the outer sleeve 25 is mounted with an adjustment bolt 49 and a fastening nut 50; a screw bolt 52 mounted on the outer end of the adjustment bolt 49 is to facilitate a rivet nut 18 and a screw bolt 52 assembled together in advance. The riveting length of the rivet nut 18 is to be adjusted by means of screwing and moving the outer sleeve 25 so as to have the adjustment ring 31 of the rivet-stroke adjusting assembly 54 moved to a rivet stroke as desired.

The inside of the body portion 13 of the rivet-nut gun 11 is mounted with a pneumatic motor assembly 57, of which the front end is mounted with a hydraulic piston 20. A hydraulic chamber 19 is mounted between the hydraulic piston 20 and the body portion 13; the hydraulic chamber 19 extends into the inner space of the handle 15; by means of the pressure accumulator 16 under the handle 15, the pressure air entered can be converted into a hydraulic power to drive the hydraulic piston 20 and the pneumatic motor assembly 57 to move backwards so as to perform the rivet-pulling work by using the rivet nut 18. The pull shaft 24 on the front end of the hydraulic piston 20 and the torque rod 21 in the cylindrical hole thereof extend into the cylindrical hole 23 of the mount base 22 on the front end of the body portion 13. The outer end of the pull shaft 24 is furnished with outer threads 55; the outer surface of the pull shaft 24 is mounted with a rivet-stroke adjusting assembly 54; the outer threads 55 is mounted with a thread sleeve 36; the outer threads 56 of the torque rod 21 in the pull shaft 24 extends out of the pull shaft 24 so as to facilitate the inner sleeve 26 of the rivet-pulling assembly 17 to screw together firmly.

The rivet-pulling assembly 17 on the front end of the body portion 13 includes an inner sleeve 26, a pull rod 12, an outer sleeve 25, an adjustment bolt 49 and a fastening nut 50; both ends of the inner sleeve 26 are furnished with threaded holes respectively; the inner end thereof is screwed together with the outer threads 56 of the torque rod 21, while the threaded hole of the outer end thereof is to be screwed together with a replaceable pull rod 12. One end of the outer sleeve 25 is mounted with a positioning ring 44 having a round surface 48 and a ring groove 45; the positioning ring is plugged in a cylindrical hole 23 of the mounting base 22 in the body portion 13, and the other end thereof is furnished with a threaded hole for receiving an adjustment bolt 49, of which the outer threads is mounted with a fastening nut 50 for fastening the adjustment bolt 49 in place after each adjustment. The pull rod 12 is mounted in and through the center hole of the adjustment bolt 49, and the end thereof is furnished with threads to screw in the threaded hole of the inner sleeve 26; the screw bolt 52 on the outer end thereof is designed to fit to the threads of the rivet nut 18, the screw bolt 52 is first screwed together with the rivet nut 18, and then is connected with a working piece before a riveting work.

Figure 2:
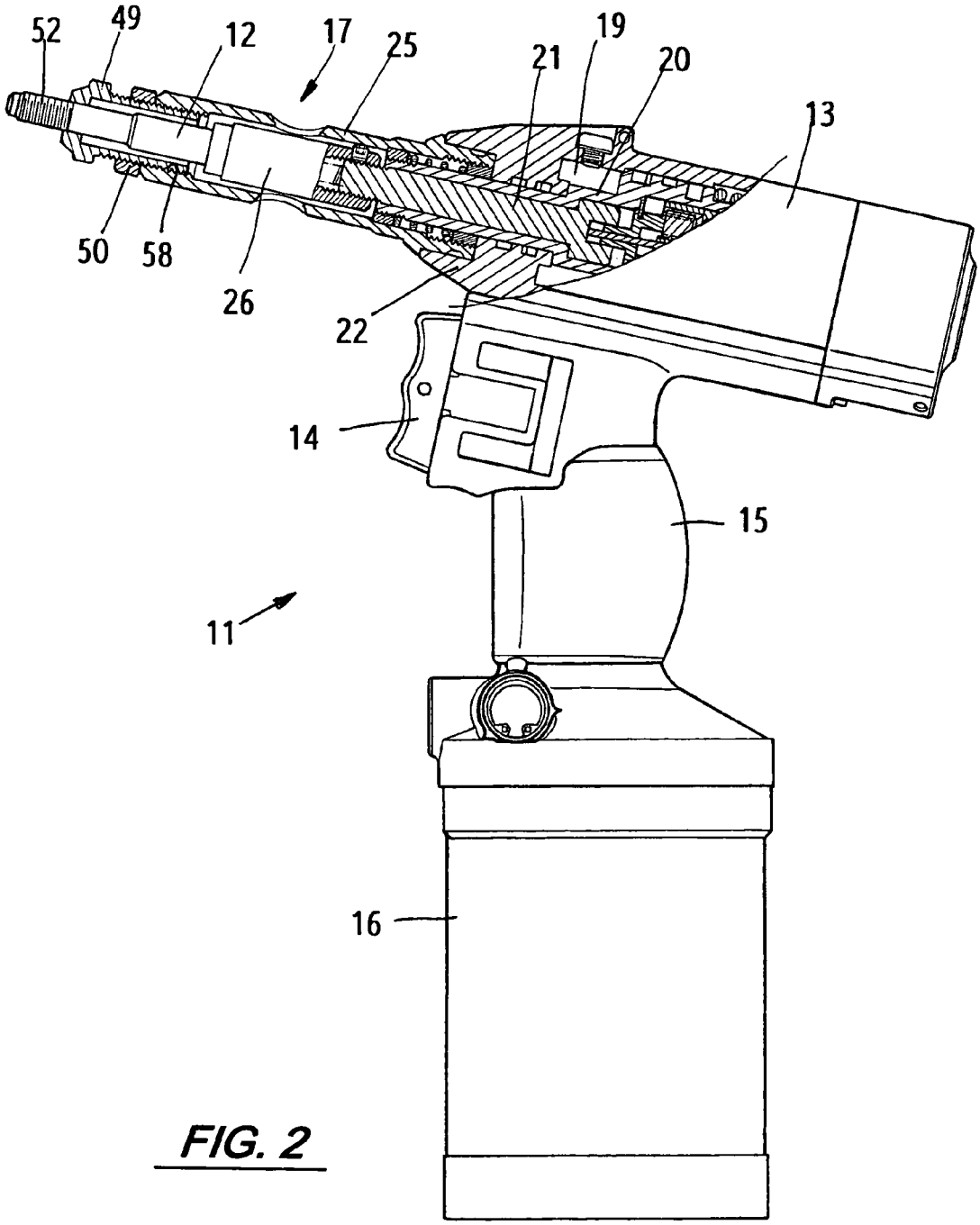
FIG. 2 is a fragmental section view of the present invention, showing the inner structure of the rivet-pulling assembly.
Figure 3:
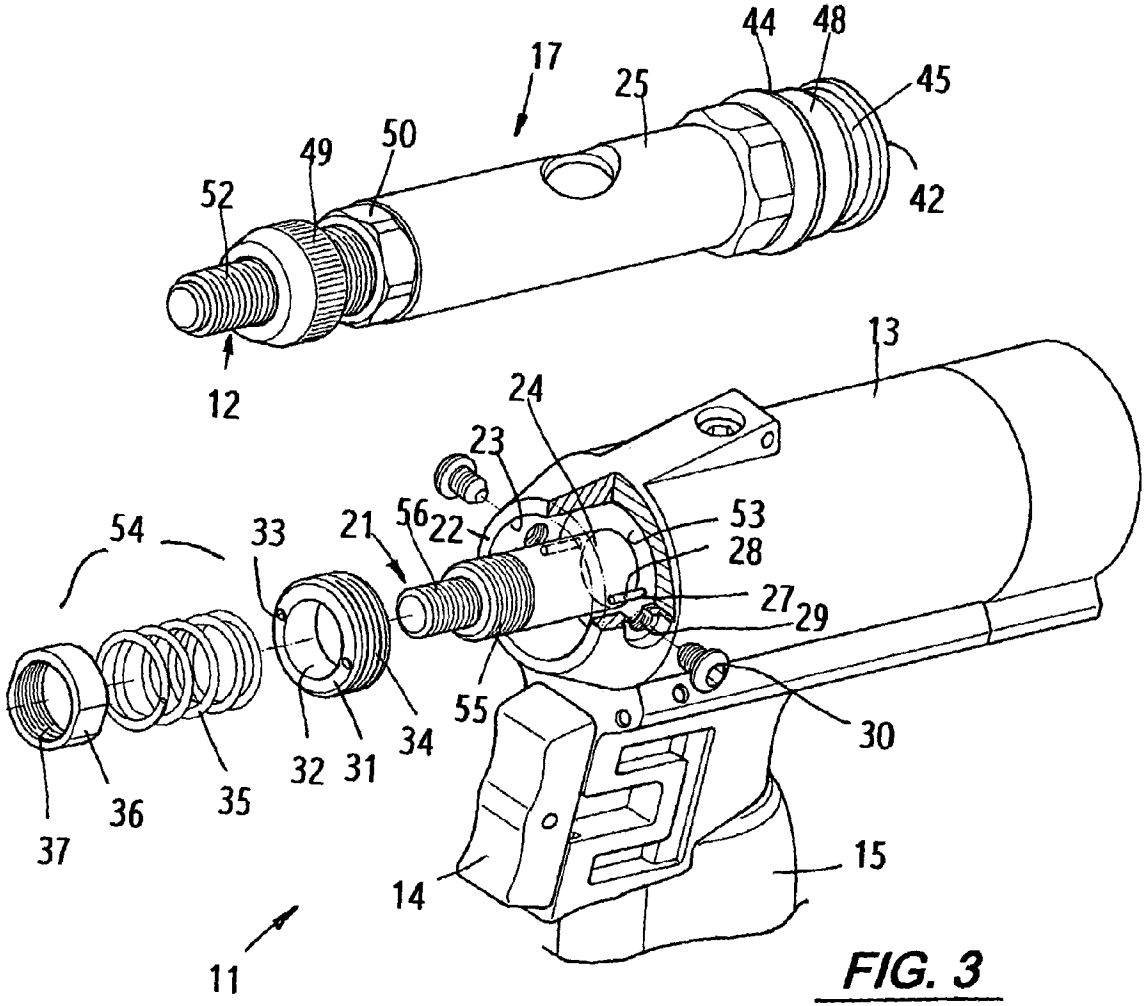
FIG. 3 is a disassembled view of the present invention, showing the structure of the rivet-stroke adjusting assembly.
Figure 6:
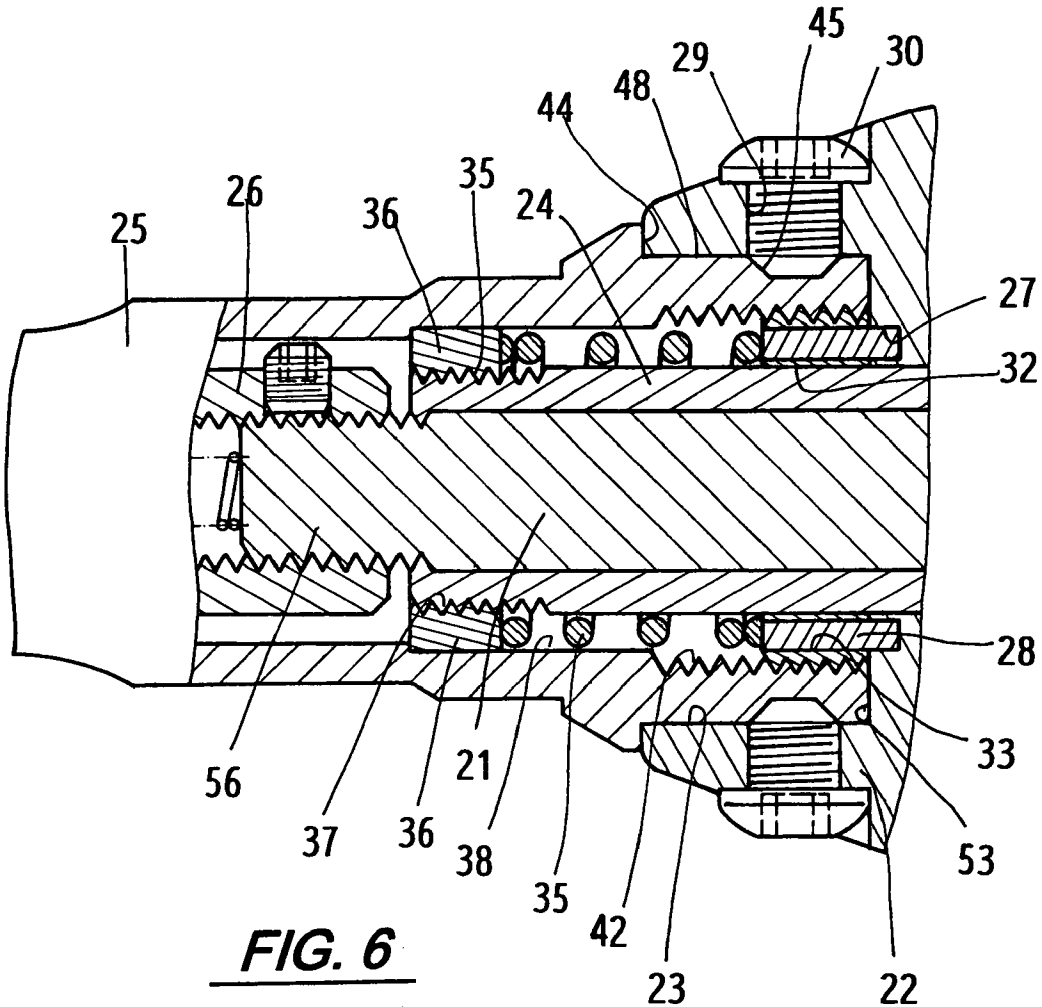
FIG. 6 is a sectional view of the present invention, showing the structure of the rivet-stroke adjusting assembly.

Referring to FIGS. 2, 3 and 6, the cylindrical hole 23 of the mounting base 22 in the body portion 13 is mounted with an outer sleeve 25; the round surface 48 thereof is mounted with a positioning ring 44, and a ring groove 45; the positioning ring 44 is used for setting a distance desired upon the round surface 48 of the outer sleeve 25 being plugged into the cylindrical hole 23; after the outer sleeve 25 is plugged into the cylindrical hole 23 of the mounting base 22, and then the ring groove 45 of the round surface 48 can be plugged into the cylindrical hole 23 at a given depth. After the outer sleeve 25 is plugged into the cylindrical hole 23 of the mounting base 22, and after the screw holes 29 on both sides of the mounting base 22 are screwed with two screws 30 respectively, the front ends of two screws 30 will be in close contact with ring grooves 45 of the round surface 48 respectively so as to prevent the outer sleeve 25 from slipping away. By means of the limit provided by the ring grooves 45 and the screws 30, the stroke length of rivet-nut gun during riveting work can be adjusted by turning the outer sleeve 25.

One end of the outer sleeve 25 plugged into the cylindrical hole of the mounting base 22 is furnished with a through cylindrical hole 38 and a threaded hole 42. The cylindrical hole 38 is used for plugging the pull shaft 24 of the rivet-stroke adjusting assembly 54 therein, and then the threaded hole 42 and the adjustment ring 31 of the rivet-stroke adjusting assembly 54 are screwed together. When the outer sleeve 25 is turned, the outer threads 34 of the adjustment ring 31 will move to provide the rivet-nut gun with proper rivet-stroke adjustment.

To assembly the outer sleeve 25 and the body portion 13 together, the rivet-stroke adjusting assembly 54 and the pull shaft 24 should be assembled together first; the torque rod 21 and the inner sleeve 26 should be assembled together, and then the outer sleeve 25 is plugged into the cylindrical hole 23 of the mounting base 22; the outer sleeve 25 should first be plugged into the front section of the cylindrical hole 23, and then the adjustment ring 31 is screwed in place so as to have the outer sleeve 25 and the adjustment ring 31 assembled together, and to have the positioning ring 44 of the outer sleeve 25 and the mounting base 22 assembled in close contact state; then, two screws 30 are screwed into two screw holes 29 respectively on both sides of the mounting base 22 so as to limit the outer sleeve 25 from slipping away.

The rivet-stroke adjusting assembly 54 mounted between the outer sleeve 25 and the body portion 13 includes an adjustment ring 31, a steel pin 28, a spring 35 and a thread sleeve 36; the adjustment ring 31 has a center cylindrical hole 32 and threads 34 on outer surface thereof; the body of the adjustment ring 31 is furnished with two symmetrical pin holes 33 for receiving steel pins 28. One end of the steel pin 28 is plugged into a pin hole 27 in the bottom round surface 53 in the cylindrical hole 23, while the other end thereof extends into the cylindrical hole 23 to facilitate the two symmetrical pin holes 33 of the adjustment ring 31 to mount on the steel pins 28 respectively. When the threads 34 of the adjustment ring 31 is driven by the outer sleeve 25, the adjustment ring 31 can only move axially along the steel pin 28; the spring 35 is mounted to the pull shaft 24; one end of the spring 35 is set against the surface of the adjustment ring 31, while the other end is set against the surface of the thread sleeve 36 so as to provide the adjustment ring 31 with a force to push inwards. The thread sleeve 36 has a threaded hole 37 to enable the same to mount to the outer threads 55 of the pull shaft 24; by means of the spring 35, the adjustment ring 31 is normally pushed against the bottom round surface 53.

Figure 7:
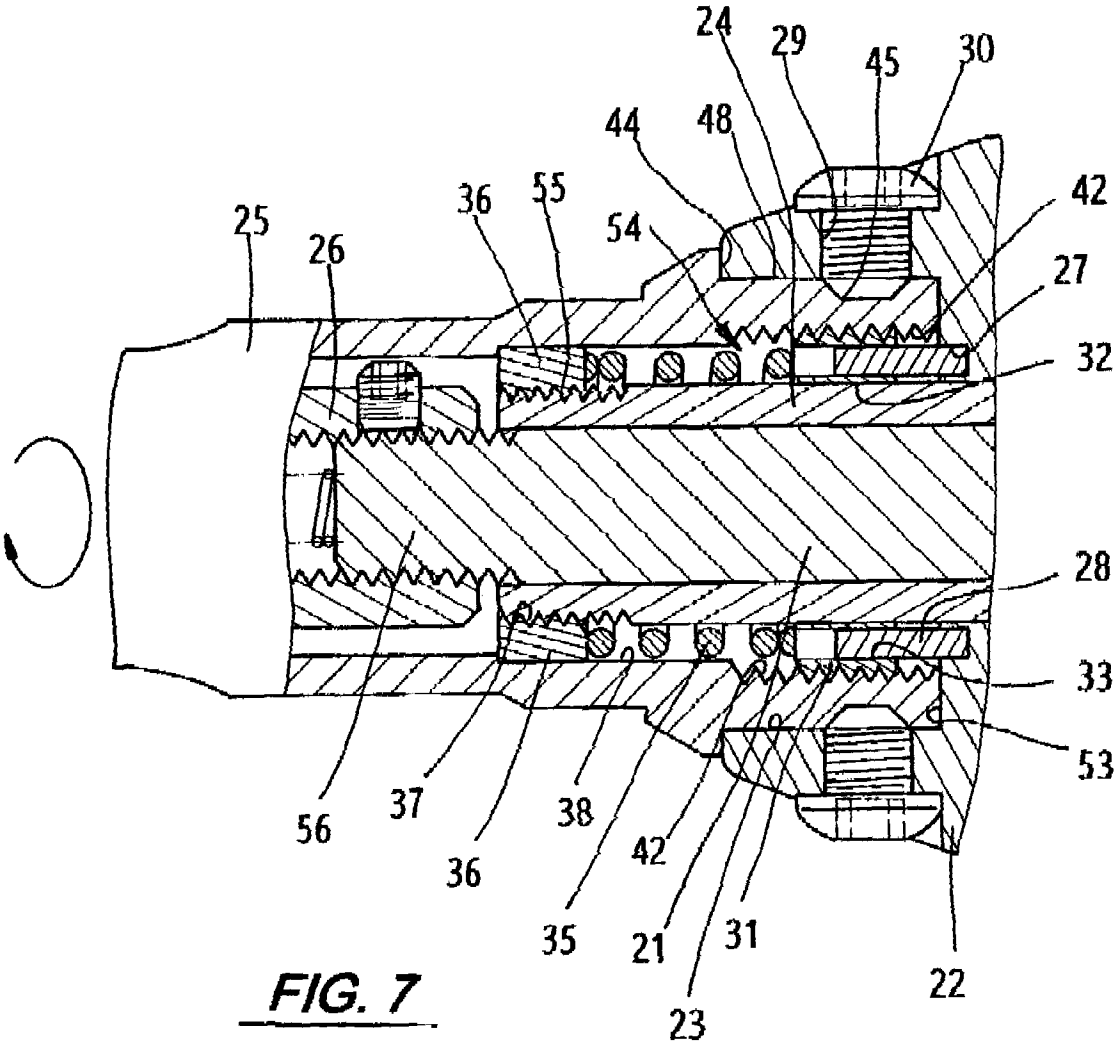
FIG. 7 is a sectional view of the present invention, showing the rivet-stroke adjusting assembly being adjusted as desired.

Referring to FIGS. 3, 6 and 7, the riveting stroke of the rivet-nut gun can be adjusted by turning the outer sleeve 25. When the outer sleeve 25 is turned, it can only be turned without slipping away because of the ring groove 45 on the round surface 48 in the cylindrical hole 23 of the mounting base 22 being detained in place by means of screws 30. When the outer sleeve 25 is turned, the adjustment ring 31 in the threaded hole 42 can only be turned axially simultaneously with the outer sleeve 25 because of being limited by the steel pin 28 on the bottom round surface 53 in the cylindrical hole 23.

The adjustment ring 31 is mounted to the pull shaft 24 through the cylindrical hole 32, and the spring 35 is mounted to the outer end thereof; the threads 41 on the end of the pull shaft 24 is mounted with a thread sleeve 36. The adjustment ring 31 moves axially along the pull shaft 24 upon the outer sleeve 25 being turned; the moving stroke thereof is generally designed at 7 millimeters, and such a moving stroke is equal to a distance between the adjustment ring 31 and the thread sleeve 36 to deduct a length upon the spring 35 being compressed.

Figure 4:
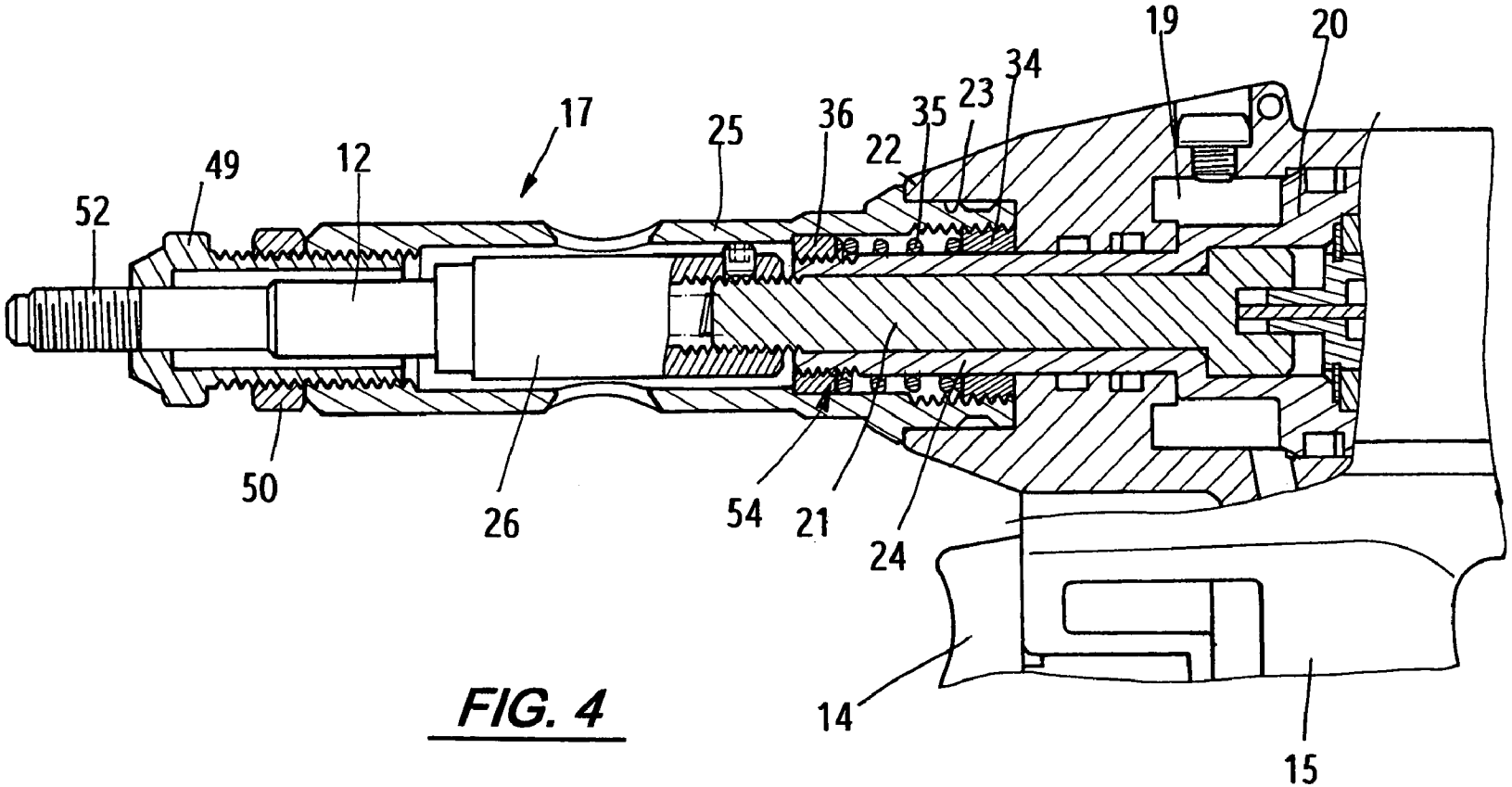
FIG. 4 is a sectional view of the present invention, showing the rivet nut gun not in riveting state.
Figure 5:
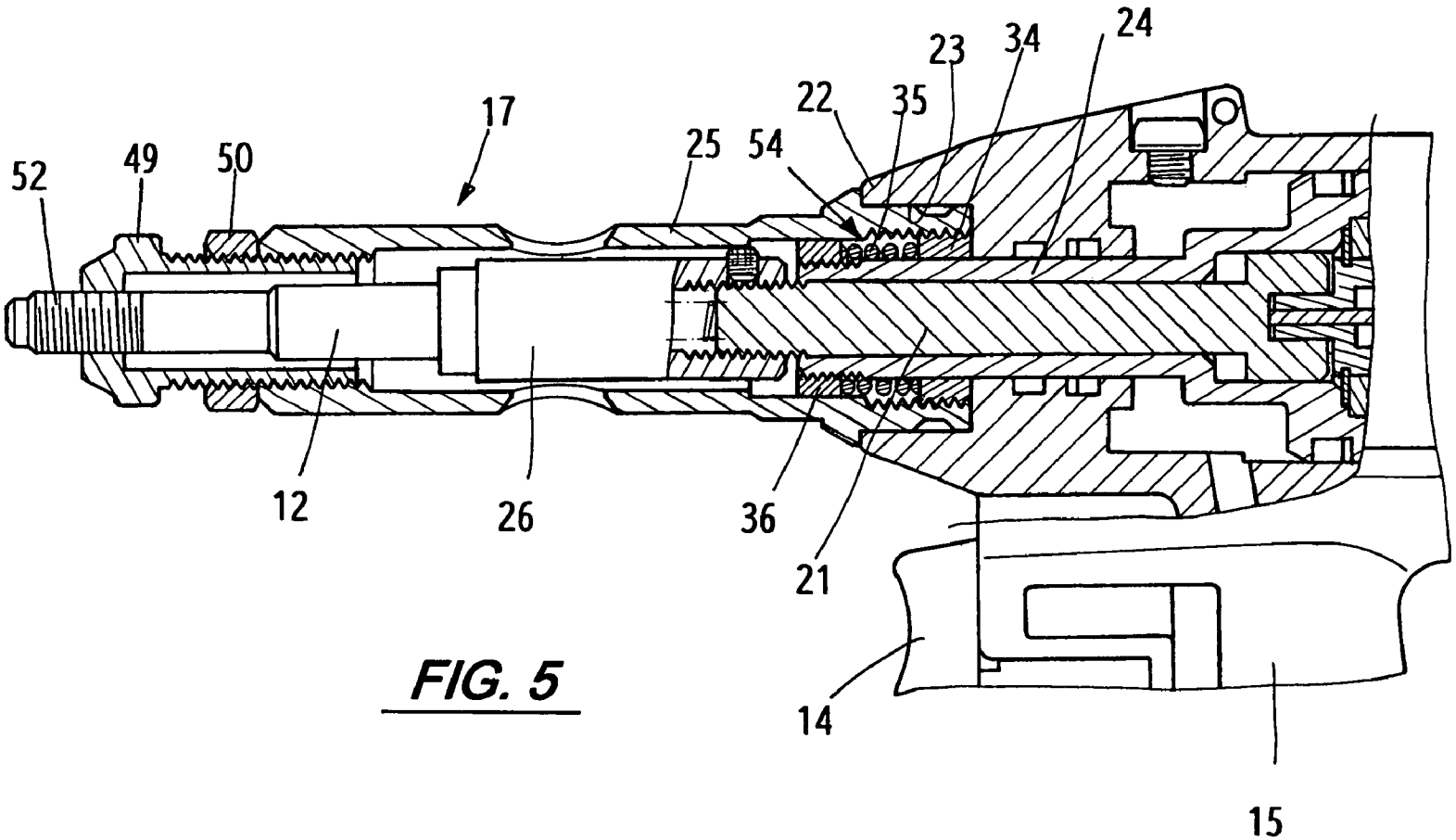
FIG. 5 is a sectional view of the present invention, showing the rivet-pulling work being done.

As shown in FIGS. 4 and 6, the maximum stroke of 7 millimeters is designed between the adjustment ring 31 and thread sleeve 36 for the rivet-stroke adjusting assembly 54 on the pull shaft 24; as shown in FIG. 5, the hydraulic piston 20 in the pull shaft 24, during riveting work, will be pushed by the hydraulic pressure form the hydraulic chamber 19 to move outwards to the outer end of the body portion 13; when the pull shaft 24 is driven to move, the pushing force would be strong enough to enable the rivet nut 18 to do a riveting work; during the riveting work with the pull shaft 24, the spring 24 would be compressed to a condition that there is no gap left among the spring wire.

To adjust the rivet stroke, turn the outer sleeve 25 to a position as required; as shown in FIGS. 3, 6 and 7, when the outer sleeve 25 is turned, the threaded hole 42 thereof will drive the adjustment ring 31 to move axially along the steel pin 28 so as to adjust a riveting stroke properly.

In order to judge a rivet stroke easily, a groove 60 is furnished on the mounting base 22 of the body 13 as shown in FIGS. 8 to 12; the outer surface of the groove 60 is furnished with scale 62. The adjustment ring 31 on the pull shaft 24 is furnished with a pin hole 66 opposite to the groove 60; the pin hole 66 is used for plugging and fastening one end of a U-shaped indication pin 63, while the other end thereof (i.e., the pin body 65) is mounted in the groove 60.

Figure 8:
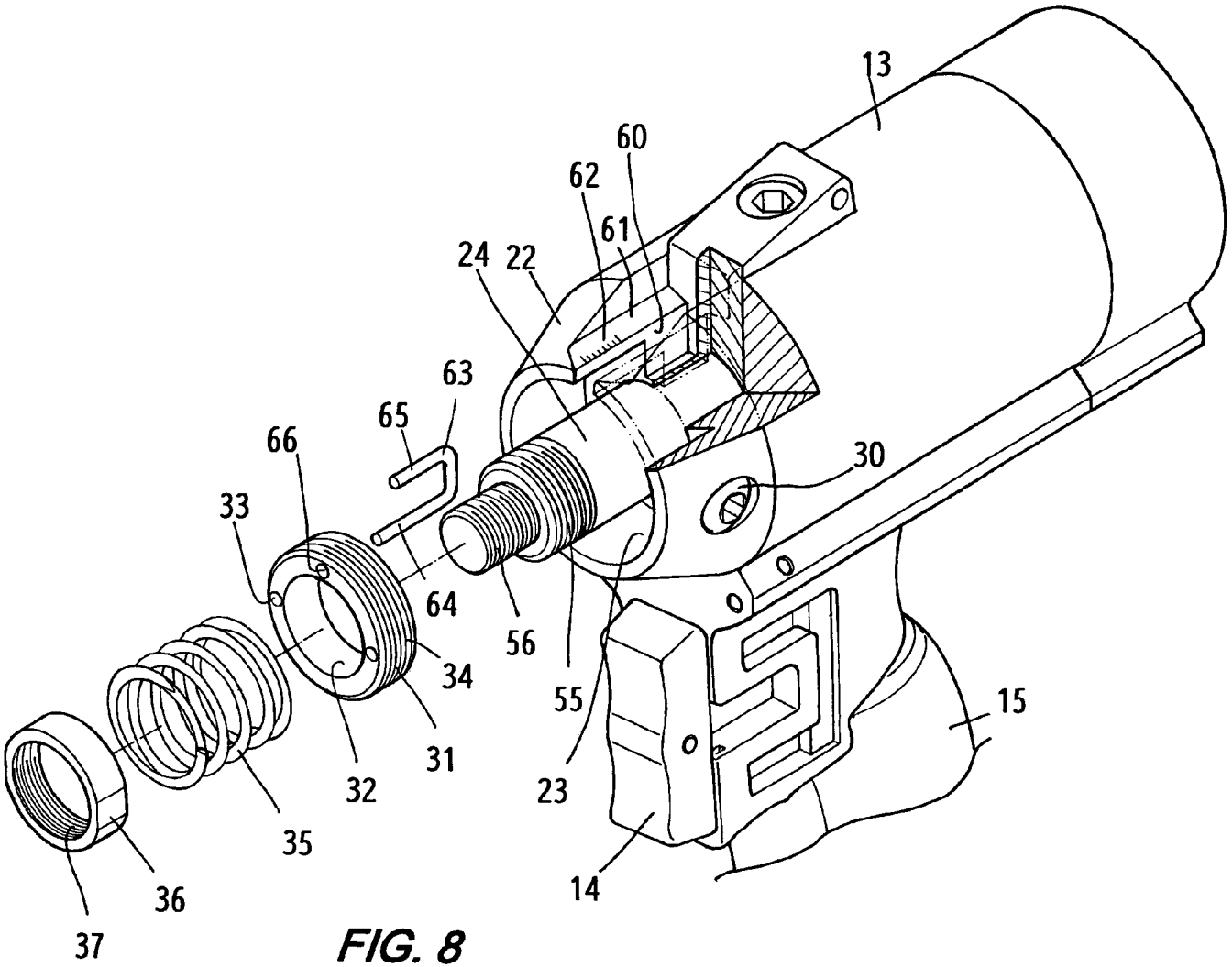
FIG. 8 is a disassembled view of the present invention, showing the rivet-stroke adjusting assembly furnished with an indication pin.
Figure 9:
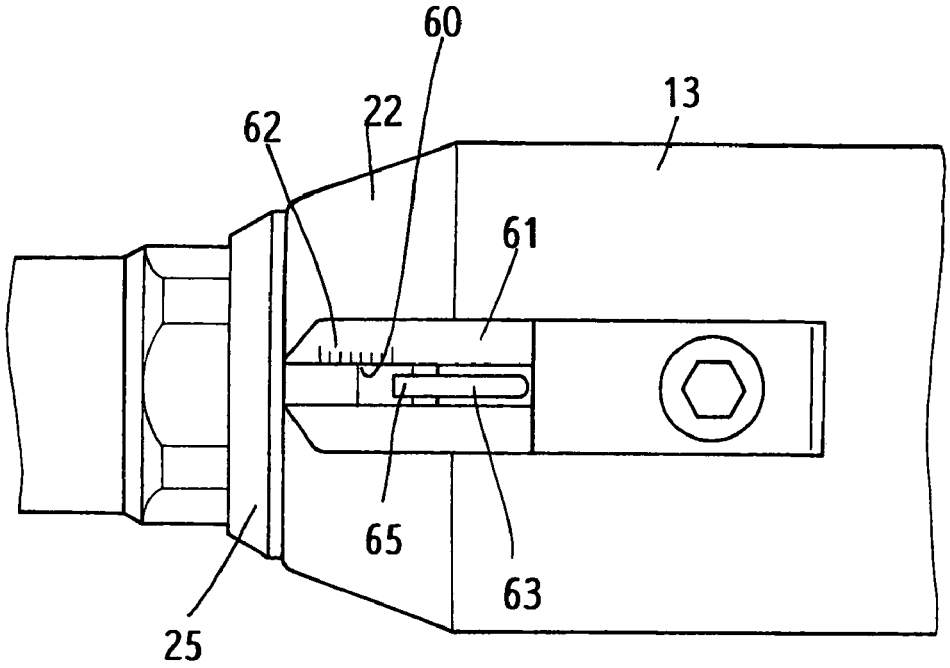
FIG. 9 is a plan view of the present invention, showing the indication relation between the indication pin and the scale.
Figure 10:
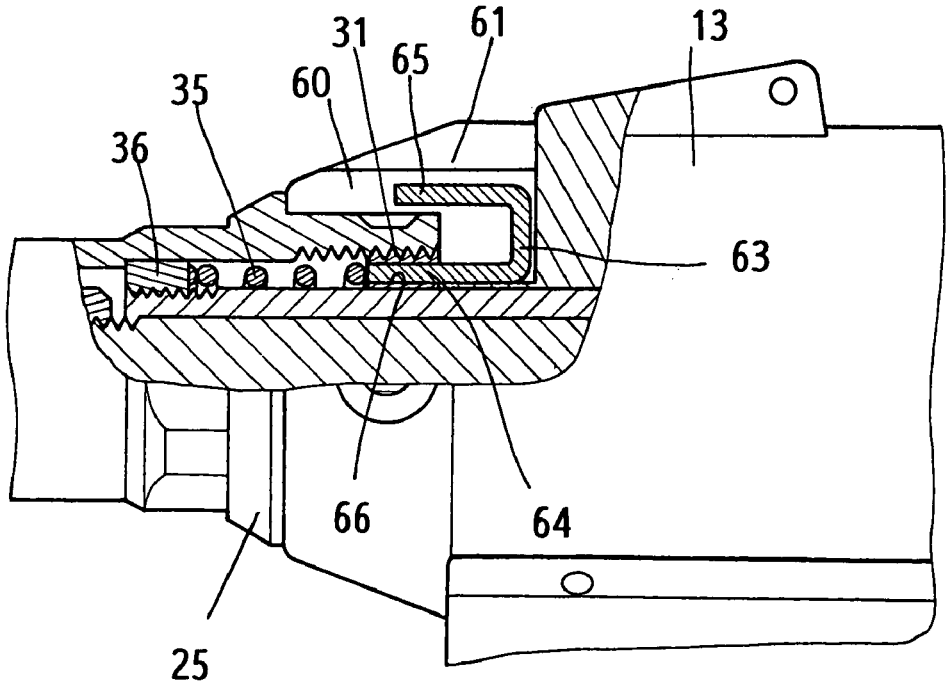
FIG. 10 is a sectional view of the present invention, showing the structure of the indication pin.
Figure 11:
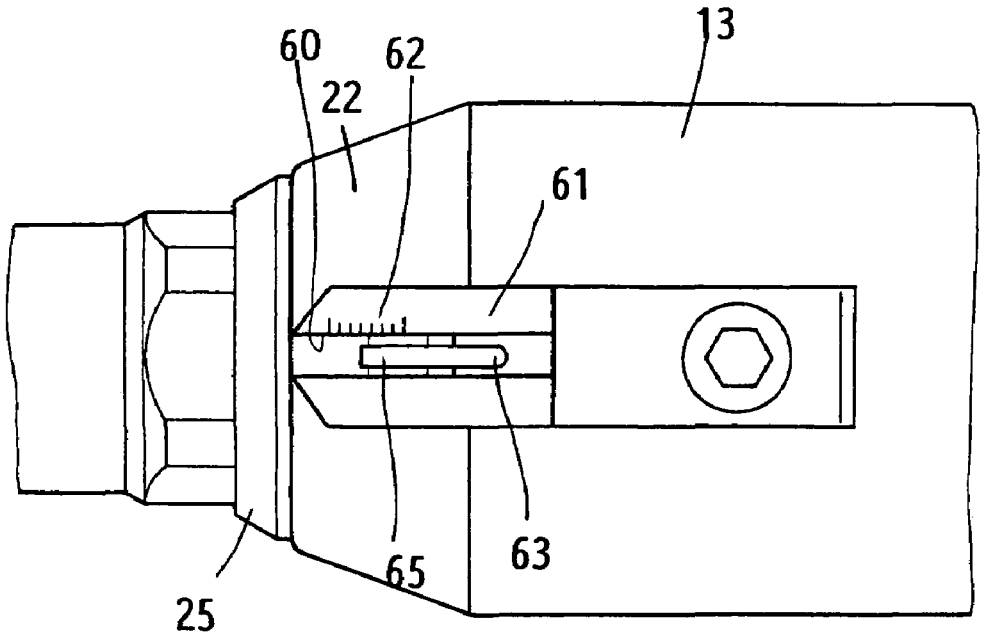
FIG. 11 is a plan view of the present invention, showing the indication pin being set at a given position to indicate the rivet stroke adjustment.
Figure 12:
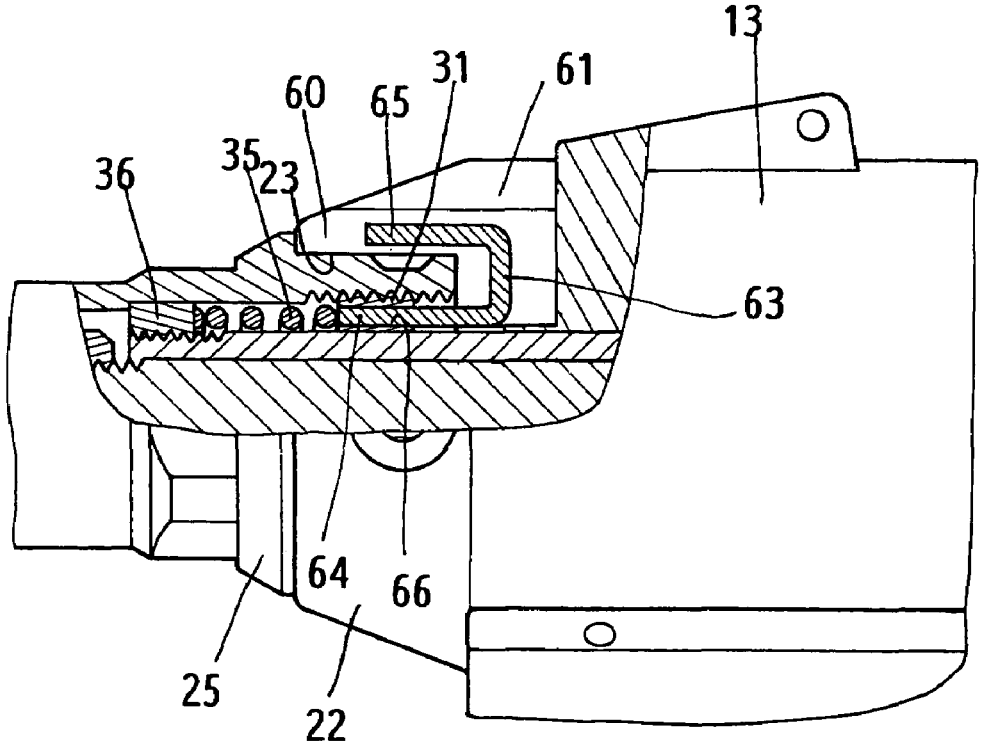
FIG. 12 is a sectional view of the present invention, showing the relation among parts upon the rivet-stroke adjusting assembly being adjusted.

Referring to FIGS. 8 to 10, the rivet-nut gun 11 is designed to have a maximum riveting stroke; the end of the pin body 65 of the indication pin 63 in the groove 60 of the mounting base 22 is pointed to the maximum position of the scale 62; as shown in FIGS. 11 and 12, when turn the outer sleeve 25 to adjust the riveting stroke, the threaded hole 42 of the outer sleeve 25 will drive the adjustment ring 31 to move axially; simultaneously, the indication pin 63 on the adjustment ring 31 will move; then, the pin body 65 of the indication pin 63 will move along the groove 60 to indicate the riveting stroke distance by the scale 62 of the groove 60.

While the invention has been described with reference to specific embodiments it must be understood that those embodiments are susceptible to many changes, substitutions, and modifications that will be readily apparent to those having ordinary skill in the art without departing from the scope and spirit of the invention.

What is claimed is:

1. A rivet-stroke adjusting device for a rivet-nut gun comprising:

a) a body portion having a rivet-pulling assembly protruding from a front end thereof;

b) a mounting base located on the front end of the body portion and having a cylindrical hole and two symmetrical holes receiving two screws therein; and c) a rivet-stroke adjusting assembly located between the rivet-pulling assembly and a pull shaft located in the cylindrical hole of the mounting base, the rivet-stroke adjusting assembly having:

i) an adjustment ring having a center adjustment ring hole, outer threads, and two symmetrical adjustment ring pin holes, the pull shaft being inserted through the center adjustment ring hole;

ii) two steel pins, a first end of one of the two steel pins being inserted into each of the two symmetrical adjustment ring pin holes, and a second end of one of the two steel pins being inserted into each of two symmetrical mounting base holes on a bottom round surface of the of the cylindrical hole of the mounting base;

iii) a thread sleeve threadedly connected to the pull shaft;

i) a spring located on the pull shaft between the adjustment ring and the thread sleeve; and ii) an outer sleeve having an outer sleeve cylindrical through hole with a threaded end threadedly connected to the outer threads of the adjustment ring.

2. The rivet-stroke adjusting device according to claim 1, wherein the outer sleeve includes a ring groove and a positioning ring, the ring groove aligning with the two symmetrical holes of the mounting base.

3. The rivet-stroke adjusting device according to claim 1, further comprising a torque rod, the cylindrical hole of the mounting base having the pull shaft and the torque rod inserted therein, the adjustment ring and the thread sleeve being spaced apart a predetermined distance being a riveting stroke of a rivet nut of the rivet-nut gun.

4. The rivet-stroke adjusting device according to claim 1, further comprising an indication pin, the mounting base has a longitudinal groove and a scale located on an outer surface thereof adjacent to the longitudinal groove, a first end of the indication pin is inserted into the longitudinal groove.

5. The rivet-stroke adjusting device according to claim 4, wherein the adjustment ring includes an adjustment ring indication pin hole, a second end of the indication pin is inserted into the adjustment ring indication pin hole.

6. The rivet-stroke adjusting device according to claim 4, wherein the indication pin is a U-shaped pin.

7. A rivet-stroke adjusting device for a rivet-nut gun comprising:

a) a body portion having a rivet-pulling assembly protruding from a front end thereof;

b) a mounting base located on the front end of the body portion and having a cylindrical hole and two symmetrical holes receiving two screws therein, the mounting base having a longitudinal groove and a scale located on an outer surface thereof adjacent to the longitudinal groove; and c) a rivet-stroke adjusting and a motion indication assembly located between the rivet-pulling assembly and a pull shaft located in the cylindrical hole of the mounting base, the motion indication assembly having:

i) an adjustment ring having a center adjustment ring hole, outer threads, and adjustment ring indication pin hole, the pull shaft being inserted through the center adjustment ring hole; and ii) an indication pin being a U-shaped pin, a first end of the indication pin is inserted into the longitudinal groove, a second end of the indication pin is inserted into the adjustment ring indication pin hole.

* * * * *